United States Patent [19]

Kotaki et al.

[11] Patent Number: 4,983,946

[45] Date of Patent: Jan. 8, 1991

[54] VARIABLE RESISTOR WITH SWITCHING MECHANISM

[75] Inventors: Mitsuko Kotaki; Yukihisa Oda, both of Chiryu; Takayoshi Tsuzuki, Toyota, all of Japan

[73] Assignee: Aisin Seiki Kabushiki Kaisha, Kariya, Japan

[21] Appl. No.: 357,961

[22] Filed: May 30, 1989

[30] Foreign Application Priority Data

May 30, 1988 [JP] Japan ..... 63-132206

[51] Int. Cl.[5] ..... H01C 10/50; H01C 10/36

[52] U.S. Cl. ..... 338/200; 338/172; 338/198

[58] Field of Search ..... 338/200, 172, 174, 198

[56] References Cited

U.S. PATENT DOCUMENTS 4,682,142 7/1987 Lohner et al. ..... 338/172

4,903,003 2/1990 Kuratani et al. ..... 338/198

*Primary Examiner*—Bruce A. Reynolds

*Assistant Examiner*—Marvin M. Lateef

*Attorney, Agent, or Firm*—Burns, Doane, Swecker & Mathis

[57] ABSTRACT

A variable resistor having a switching function includes a base plate, a first electrode formed on the base plate, a second electrode formed on the base plate, a third electrode formed on the base plate, and a fourth electrode formed on the base plate simultaneously with the formation of the second electrode. A resistive element connects electrically the first and the second electrodes, a first switching element is provided and includes two brushes which slide on the surfaces of the third electrode and the resistive element, respectively. A second switching element is movable together with the first switching element and includes two brushes which slide on the surfaces of the first electrode and the fourth electrode, respectively.

7 Claims, 3 Drawing Sheets

VARIABLE RESISTOR WITH SWITCHING MECHANISM

BACKGROUND OF THE INVENTION

1. Field of Invention

The present invention relates to a variable electric resistor having a switching function and a variable electric resistor in which a brush slides on a resistive element.

2. Description of the Related Art

Generally speaking, in a variable resistor of the present kind, a brush slides on a resistive element from one end to the other end thereof after a switch is turned off. A variable resistor of this kind may be incorporated in a control system in which the rotating range defined by the pitch between ends of the resistive element coincides with the rotating range of a mechanism to be controlled. In this case, if the relationship between a position at which the switch is turned off and the other end of the resistive portion is not set correctly, the control system may malfunction. Accordingly, manufacturing of the variable resistor has to be performed in light of this fact. In general, this means that the variable resistor as discussed above is not suitable for mass-production.

SUMMARY OF THE INVENTION

Accordingly, it is an object of the present invention to provide a variable resistor without the aforementioned drawback.

It is another object of the present invention to provide a variable resistor which is suitable for mass-production with reliability.

These and other objects are achieved by a variable resistor having a switching function and comprises a base plate, a first electrode formed on the base plate, a second electrode formed on the base plate, a third electrode formed on the base plate, a fourth electrode formed on the base plate simultaneously with the formation of the second electrode, a resistive element for electrically connecting the first and the second electrodes, a first switching element including two brushes which slide on the surfaces of the third electrode and the resistive element, respectively, and a second switching element movable together with the first switching element and including two brushes which slide on the surfaces of the first electrode and the fourth electrode, respectively.

DETAILED DESCRIPTION OF THE INVENTION

Figure 1:
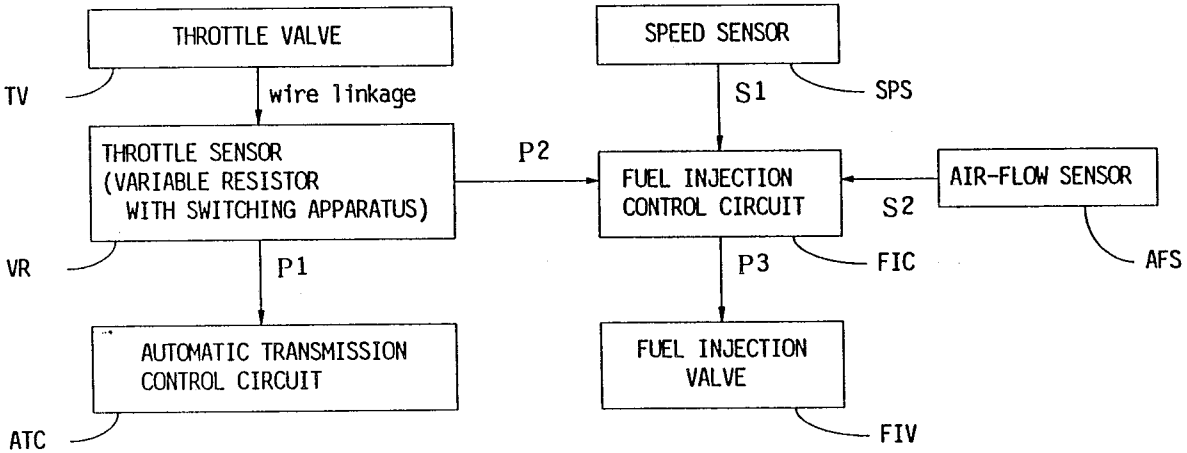
FIG. 1 shows a system diagram in which the invention is applied.

FIG. 1 shows a block diagram of a throttle-valve control system to which this invention is applied. A throttle valve TV is operatably connected to a variable resistor VR having a switching function via a suitable means such as a wire linkage or shaft member, for example. From the variable resistor VR, a control signal Pl and a control signal P2 are transmitted to an automatic transmission control circuit ATC and a fuel injection control circuit FIC, respectively. An operating signal P3 from the fuel injection control circuit FIC is fed to a fuel injection valve FIV so as to control the fuel injection valve FIV at a predetermined condition. A speed sensor SPS disposed in an automatic transmission (not shown) feeds an operating signal S1 to the fuel injection control circuit FIC. Further, an air-flow sensor AFS is positioned in a air conduit (not shown) for detecting the amount of air-flow therein. The detected air-flow amount is transmitted as an operating signal S2 to the fuel injection control circuit FIC.

Figure 2:
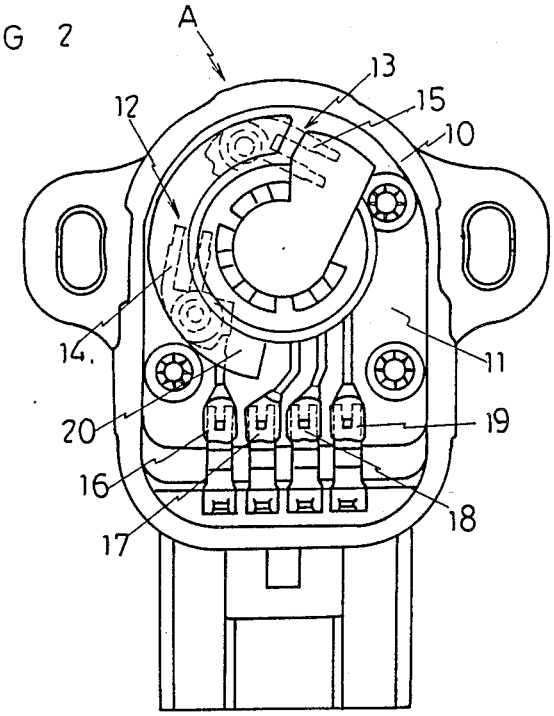
FIG. 2 shows a front view of a variable resistor with a switching mechanism according to the present invention.

Referring to FIG. 2, a variable resistor VR having a switching function comprises a body 10 including a base plate 11, a first switching element 12 and a second switching element 13 each of which is in the form of a pair of sliding brushes 14 and 15, a GND terminal 16 which is the ground terminal, an output terminal 18 and two input terminals 17 and 19.

The input terminal 17 is connected to a power source (not shown), thereby being supplied with a constant voltage. From the output terminal 18, the throttle opening signal P2 (as shown in FIG. 1) is derived whose value depends on the position of the switching element 14. According to the position of the switching element 13, it is detected whether idling operation of the vehicle is started or not. The switching elements 12 and 13 are fixedly mounted on a common rotary plate 20, so that the switching elements 12 and 13 slidably contact with the base plate 11 having a shaft (not shown) which is rotatably fitted in an aperture 22. On the surface of the base plate 11, a plurality of electrodes are printed, each of which is obtained or manufactured by a printing process which will be detailed hereinafter with reference to FIGS. 3 through 7.

Figure 3:
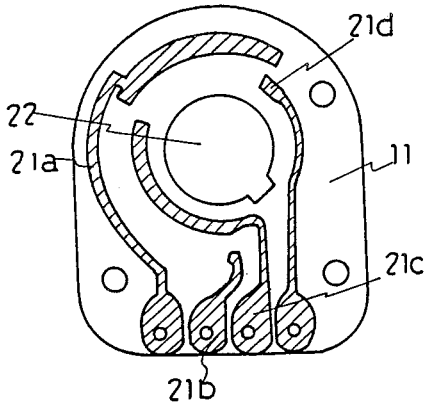
FIG. 3 shows a top view of a variable resistor base plate first manufacturing process according to the present invention.

FIG. 3 shows a first printing process. On the surface of the base plate 11, a first lower electrode **21*a*, a second lower electrode 21*b*, a third lower electrode 21*c* and a fourth lower electrode 21*d*, each of which is in the form of copper foil electrodes 21 are deposited by an etching process. The surface of the base plate 11 is preferably an epoxy resin or paper impregnated with a phenol resin, which has been etched in a predetermined pattern to accommodate the copper foil electrodes 21**. In FIG. 3, each shaded portion shows the copper foil electrode.

Figure 4:
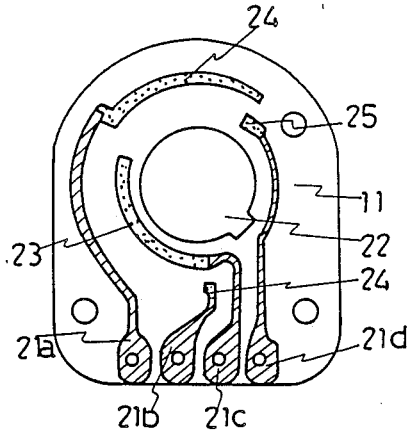
FIG. 4 shows a top view of the variable resistor base plate second manufacturing process according to the present invention.

In FIG. 4, a correcting electrode 23 is formed on the surface of the third copper foil electrode **21*c*. A potentiometer electrode 24 is formed on the surface of the second copper foil electrode 21*b*. Further, the switching electrode 25 is formed on the surface of the fourth copper foil electrode 21***d*. The collecting electrode 23, potentiometer electrode 24 and switching electrode 25 are simultaneously screen printed on the corresponding members. The paste or paint contains a heat fusible binder and a powered metal which is electrically conductive to form the correcting electrode 23, the potentiometer electrode 24 and the switching electrode 25. One suitable material as a heat fusible silver paste can be obtained from Asahi Chemical Co., Ltd., under the designation LS-504J. The main component of the heat fusible silver paste is phenol resin and silver paste. An electrical resistor of minimum resistivity is 0.05 ohms per square of substrate. On the contrary, the electrical resistor of maximum resistivity is 0.1 ohms per square of substrate. The binder in the paste is hardened using a thermosetting process. In FIG. 4, each dotted portion shows the electrode portions.

Figure 5:
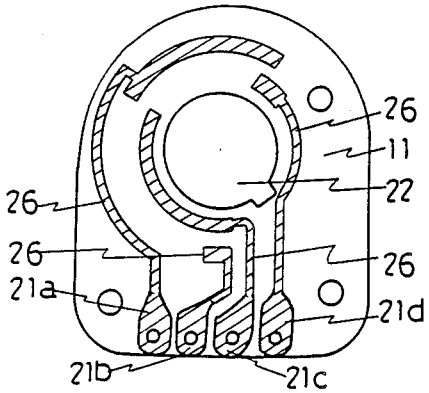
FIG. 5 shows a top view of the variable resistor base plate third manufacturing process according to the present invention.

Next, referring to FIG. 5, carbon paste layers 26 as covering elements are formed on the surface of the first copper foils 21*a*, the surface of the correcting electrode 23, the surface of the potentiometer electrode 24 and the switching electrode 25 by means a simultaneous screen printing process. The printing material is a heat fusible carbon paste sold by Asahi Chemical Co., Ltd., under the designation of BTU-100. The main component of the heat fusible carbon paste is phenol resin, carbon and filler. An electrical resistor having a resistivity is 100 ohms per square of substrate is provided. Each of the darkened portions shows the carbon paste layer 26.

Figure 6:
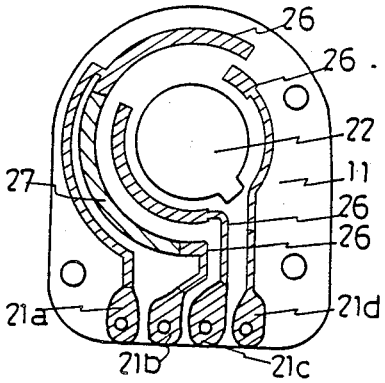
FIG. 6 shows a top view of the variable resistor base plate fourth manufacturing process according to the present invention.

Further, referring to FIG. 6, a lower resistive layer 27 is directly screen printed over the base plate 11 so as to be positioned between the carbon paste layer 26 on the second copper foil electrode 21*b* and an intermediate portion of the carbon paste layer 26 on the second copper foil electrode 21*a*. A raw material of the lower resistive layer 27 to be printed is a heat fusible carbon paste which is obtained from Asahi Chemical Co., Ltd., under the designation BTU-350. An electrical resistor having a resistivity of 350 ohms per square of substrate is provided. In the FIG. 6, the shaded portion shows the lower resistive layer 27.

Figure 7:
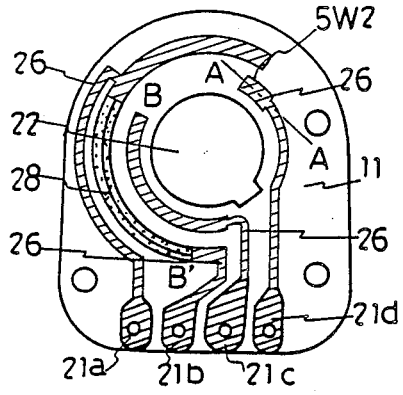
FIG. 7, shows a top view of the variable resistor base plate according to the present invention.

Furthermore, referring to FIG. 7, an upper resistive layer 28 is screen printed on the lower resistive layer 27. A raw material of the upper resistive layer 28 is a heat fusible carbon paste provided by Asahi Chemical Co., Ltd., under the designation of BTU-3K. An electrical resistor of resistivity of 3K ohms per square of substrate is provided. In the FIG. 7, the dotted portion shows the lower resistive layer 27 and the upper resistive layer 28. The lower resistive layer 27 and upper resistive layer 28, in layers, constitute a resistive electrode 29.

Figure 8:
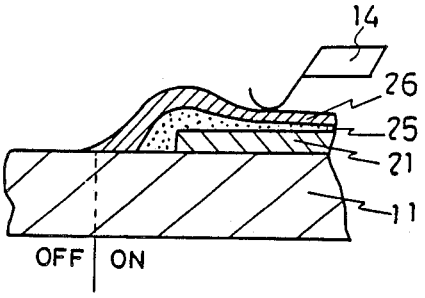
FIG. 8 shows a sectional view of the variable resistor base plate taken along line A–A' in FIG. 7.

Referring now to the FIG. 8, the drawing shows a edge portion of the switching electrode 24. The sliding brush 14 is in sliding conductive contact on the surface of the carbon paste layer 26. When the sliding brush 14 is positioned on the left side of the FIG. 7, the sliding brush 14 is not in conductive contact with the switching electrode 25. When the sliding brush 14 is positioned on the right side of the FIG. 8, the sliding brush 14 is in conductive contact with the switching electrode 25.

Figure 9:
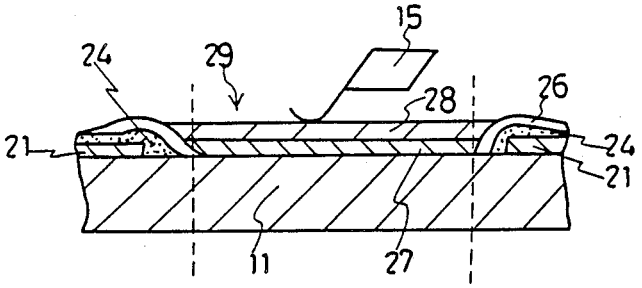
FIG. 9 shows a sectional view of the variable resistor base plate taken along line B–B' in FIG. 7.

FIG. 9 shows a sectional view of the resistive electrode 29. When the sliding brush 15 is positioned within the range of the resistive electrode 29, the sliding brush 15 is not in conductive contact with the potentiometer electrode 24. When the sliding brush 15 positioned on the left side range of FIG. 9, the sliding brush 15 is in conductive contact with the potentiometer electrode 24.

The potentiometer electrode 24 and the switching electrode 25 are screen printed simultaneously, so that the length between an edge portion 30 of the potentiometer 24 and a edge portion 31 of the switching electrode 25 is consistently determined to be substantially identical for each resistor.

The variable resistor according to the present invention has the following characteristics:

The collecting electrode, potentiometer electrode and switching electrode are covered with carbon paste layer, thereby preventing the invasion of moisture into the layered structure in the resistive electrode 29.

The potentiometer electrode and switching electrode are screen printed simultaneously. This provides a switching point so that the relative relationship between a position SW1 at which the resistive electrode 29 is zero (showing that the throttle valve is fully opened) and a position SW2 (at which the switching element 13 is turned off) is assured. This permits accurate or reliable throttle valve control operation to be obtained.

The upper resistive layer and the lower resistive layer are screen printed simultaneously. Accordingly, the structure provides an extended life variable resistor and switching mechanism.

The principles, preferred embodiments and modes of operation of the present invention have been described in the foregoing application. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims.

What is claimed is:

1. A variable resistor having a switching function and comprising:

a base plate;

a first electrode provided on the base plate;

a second electrode provided on the base plate;

a third electrode provided on the base plate;

a fourth electrode provided on the base plate simultaneously with formation of the second electrode;

a resistive element electrically connecting the first and the second electrodes;

a first switching element including two brushes slidable on surfaces of the third electrode and the resistive element, respectively; and a second switching element movable together with the first switching element and including two brushes slidable on surfaces of the first electrode and the fourth electrode respectively.

2. A variable resistor according to claim 1, wherein an end of the first electrode and an end of the second electrode is connected to the resistive element.

3. A variable resistor having a switching function and comprising:

a base plate;

a first electrode provided on the base plate;

a second electrode provided on the base plate;

a third electrode provided on the base plate;

a fourth electrode provided on the base plate simultaneously with formation of said second electrode;

a first resistive layer printed over portions of said electrodes;

a second resistive layer printed over said electrodes;

a third resistive layer printed over said base plate to connect said first and second electrodes;

a fourth resistive layer printed over said third resistive layer;

a first switching element including two brushes slidable on surfaces of said third electrode and said fourth resistive layer; and a second switching element movable together with said first switching element and including two brushes slidable on surfaces of said first electrode and said fourth electrode respectively.

4. A variable resistor having a switching function as claimed in claim 3, wherein said first resistive layer is formed out of a heat fusible silver paste with a resistivity substantially between 0.05 ohms/square and 0.1 ohms/-square.

5. A variable resistor having a switching function as claimed in claim 3, wherein said second resistive layer is formed out of a heat fusible carbon paste with a resistivity of substantially 100 ohms/square.

6. A variable resistor having a switching function as claimed in claim 3, wherein said third resistive layer is formed out of a heat fusible carbon paste with a resistivity of substantially 350 ohms/square.

7. A variable resistor having a switching function as claimed in claim 3, wherein said fourth resistive layer is formed out of a heat fusible carbon paste with a resistivity of substantially 3000 ohms/square.

* * * * *